US005460329A

United States Patent [19]

Sturman

[11] Patent Number: 5,460,329

[45] Date of Patent: Oct. 24, 1995

[54] HIGH SPEED FUEL INJECTOR

[76] Inventor: Oded E. Sturman, 3973 Santa Monica Ct., Newbury Park, Calif. 91320

[21] Appl. No.: 254,271

[22] Filed: Jun. 6, 1994

[51] Int. Cl.[6] ..... F02M 47/02

[52] U.S. Cl. ..... 239/96; 239/88; 251/129.1

[58] Field of Search ..... 239/88, 90, 92, 239/96; 251/30.01, 129.1

[56] References Cited

U.S. PATENT DOCUMENTS

| | | | |
|---|---|---|---|
| 1,700,228 | 1/1929 | Kendall | 251/129.16 X |
| 2,930,404 | 3/1960 | Kowalski | 251/129.16 X |
| 2,967,545 | 1/1961 | Schmidt | 251/129.1 |
| 3,368,791 | 2/1968 | Wells | 251/129.16 X |
| 3,743,898 | 7/1973 | Sturman | 361/194 |
| 3,995,652 | 12/1976 | Belart et al. | 137/102 |
| 4,182,492 | 1/1980 | Albert et al. | 239/92 |
| 4,275,693 | 6/1981 | Leckie | 239/89 X |
| 4,279,385 | 7/1981 | Straubel et al. | 239/90 |
| 4,392,612 | 7/1983 | Deckard et al. | 82/165 |
| 4,405,082 | 9/1983 | Walter et al. | 239/92 |
| 4,482,094 | 11/1984 | Knape | 239/88 |
| 4,550,875 | 11/1985 | Teerman et al. | 239/88 |
| 4,605,166 | 8/1986 | Kelly | 239/88 |
| 4,741,478 | 5/1988 | Teerman et al. | 239/88 |
| 4,979,674 | 12/1990 | Taira et al. | 239/88 |
| 5,108,070 | 4/1992 | Tominaga | 251/129.1 |

FOREIGN PATENT DOCUMENTS

| | | | |
|---|---|---|---|
| 264710 | 1/1950 | Germany . | |
| 0892121 | 3/1962 | United Kingdom | 251/129.1 |

OTHER PUBLICATIONS

*Communications Architecture for Multiprocessor Networks*, Nowatzyk, G, Ph.D. dissertation, Carnegie Mellon University, 1989, (see chapter 3).

*Primary Examiner*—Kevin P. Shaver

*Attorney, Agent, or Firm*—Blakely, Sokoloff, Taylor & Zafman

[57] ABSTRACT

A fuel injector which has a double solenoid three-way or four-way spool valve that controls the flow of a working fluid that is used to move an intensifier piston of the injector.

26 Claims, 4 Drawing Sheets

HIGH SPEED FUEL INJECTOR

BACKGROUND OF THE INVENTION

1. Field of the Invention

The present invention relates to a fuel injector for an internal combustion engine.

2. Description of the Related Art

Fuel injectors are used to introduce pressurized fuel into the combustion chamber of an internal combustion engine. FIG. 1 shows a fuel injection system 10 of the prior art. The injection system includes a nozzle 12 that is coupled to a fuel port 14 through an intensifier chamber 16. The intensifier chamber 16 contains an intensifier piston 18 which reduces the volume of the chamber 16 and increases the pressure of the fuel therein. The pressurized fuel is released into a combustion chamber through the nozzle 12.

The intensifier piston 18 is stroked by a working fluid that is controlled by a poppet valve 20. The working fluid enters the valve through port 22. The poppet valve 20 is coupled to a solenoid 24 which can be energized to pull the valve into an open position. As shown in FIG. 2, when the solenoid 24 opens the poppet valve 20, the working fluid applies a pressure to the intensifier piston 18. The pressure of the working fluid moves the piston 18 and pressurizes the fuel. When the solenoid 24 is deenergized, springs 26 and 28 return the poppet valve 20 and the intensifier piston 18 back to the original positions.

Spring return fuel injectors are relatively slow because of the slow response time of the poppet valve return spring. Additionally, the spring rate of the spring generates an additional force which must be overcome by the solenoid. Consequently the solenoid must be provided with enough current to overcome the spring force and the inertia of the valve. Higher currents generate additional heat and degrade the life and performance of the solenoid. Furthermore, the spring rate of the springs may change because of creep and fatigue. The change in spring rate will create varying results over the life of the injector.

Conventional fuel injectors typically incorporate a mechanical feature which determines the shape of the fuel curve. Mechanical rate shapers are relatively inaccurate and are susceptible to wear and fatigue. Additionally, fuel leakage into the spring chambers of the nozzle and the intensifier may create a hydrostatic pressure that will degrade the performance of the valve.

The graph of FIG. 3 shows an ideal fuel injection rate for a fuel injector. To improve the efficiency of the engine, it is desirable to pre-inject fuel into the combustion chamber before the main discharge of fuel. As shown in phantom, the fuel curve should ideally be square so that the combustion chamber receives an optimal amount of fuel. Actual fuel injection curves have been found to be less than ideal, thereby contributing to the inefficiency of the engine. It is desirable to provide a high speed fuel injector that will supply a more optimum fuel curve than fuel injectors in the prior art.

As shown in FIGS. 1 and 2, the poppet valve constantly strikes the valve seat during the fuel injection cycles of the injector. Eventually the seat and the popper valve will wear, so that the valve is not properly seated within the valve chamber. Improper valve seating may result in an early release of the working fluid into the intensifier chamber, causing the injector to prematurely inject fuel into the combustion chamber. It would be desirable to provide an injector valve that did not create wear between the working fluid control valve and the associated valve seat of the injector.

SUMMARY OF THE INVENTION

The present invention is a fuel injector which has a double solenoid three-way or four-way spool valve that controls the flow of a working fluid that is used to move an intensifier piston of the injector. The fuel injector includes a nozzle which is in fluid communication with a fuel port through a pressure chamber. The pressure chamber contains an intensifier piston which can move to decrease the volume of the chamber and increase the pressure of the fuel. The pressurized fuel is discharged into the combustion chamber of an engine through the nozzle of the injector.

The spool valve is moved by a pair of solenoids between a first position and a second position. Movement of the spool valve provides fluid communication between the intensifier piston and the working fluid ports of the injector, so that the working fluid strokes the intensifier piston. It has been found that the solenoid control valve of the present invention is very responsive and provides a more optimal fuel curve than injectors in the prior art. Additionally, the spool valve moves between bearing surfaces of a valve housing that are separate from the valve seats of the working fluid ports, thereby reducing wear on the seats and insuring a repeatable operation of the control valve.

BRIEF DESCRIPTION OF THE DRAWINGS

The objects and advantages of the present invention will become more readily apparent to those ordinarily skilled in the art after reviewing the following detailed description and accompanying drawings, wherein.

DETAILED DESCRIPTION OF THE INVENTION

Figure 4:
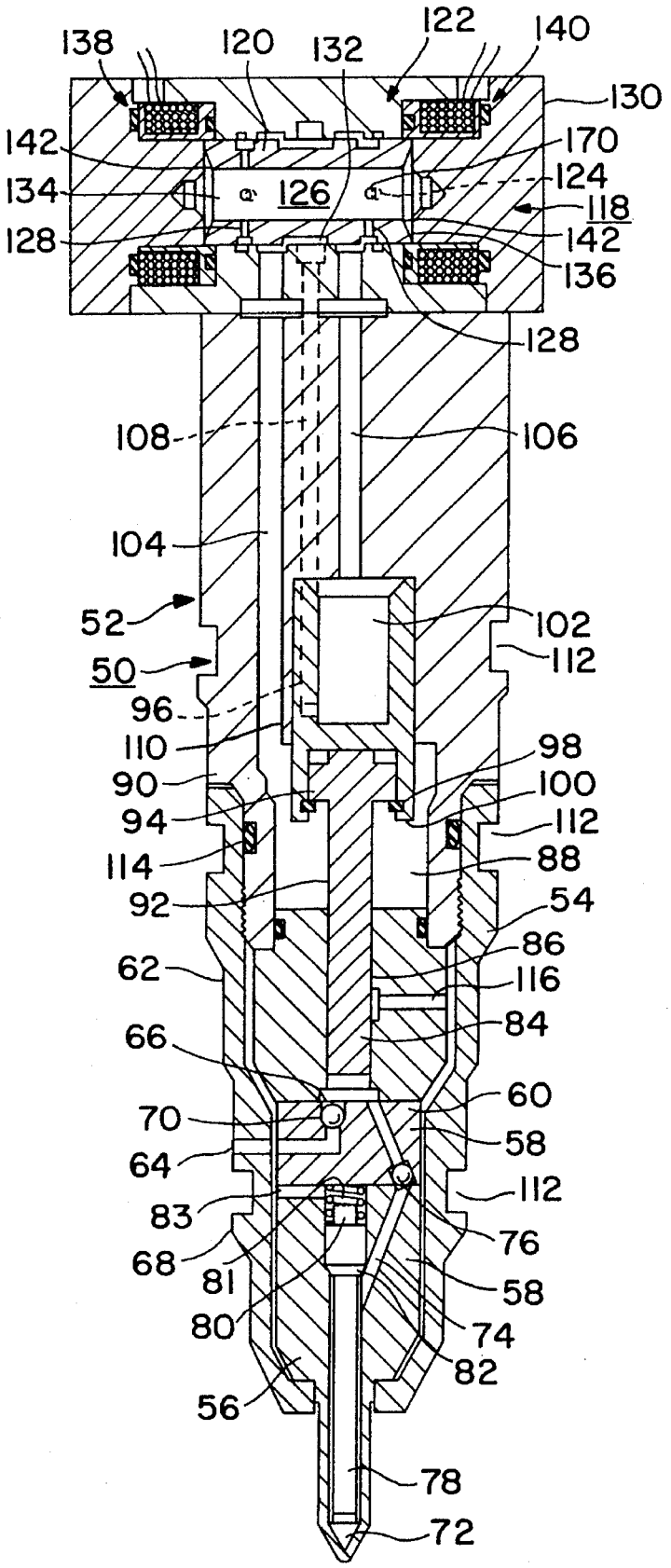
FIG. 4 is a cross-sectional view of a fuel injector with a four-way control valve that has a spool valve in a first position.
Figure 5:
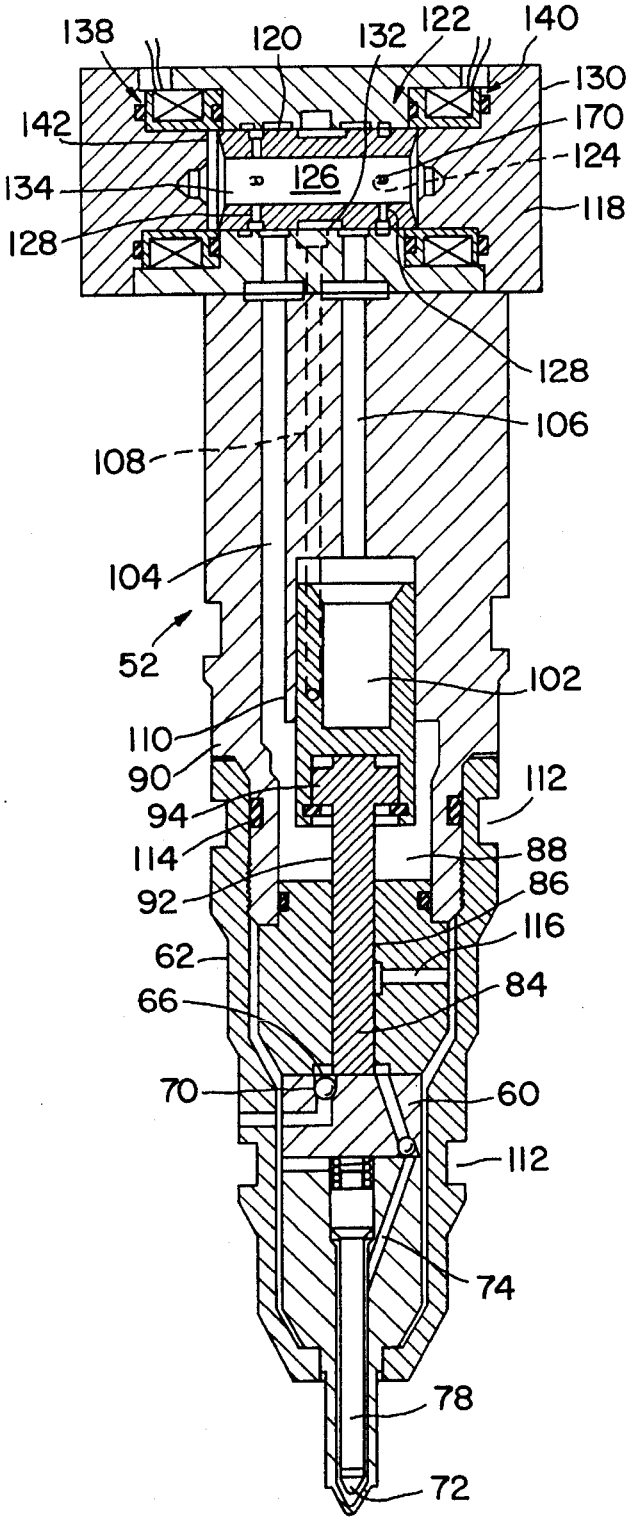
FIG. 5 is a cross-sectional view of the fuel injector with the spool valve in a second position.

Referring to the drawings more particularly by reference numbers, FIGS. 4 and 5 show a fuel injector 50 of the present invention. The fuel injector 50 is typically mounted to an engine block and injects a controlled pressurized volume of fuel into a combustion chamber (not shown). The injector 50 of the present invention is typically used to inject diesel fuel into a compression ignition engine, although it is to be understood that the injector could also be used in a spark ignition engine or any other system that requires the injection of a fluid.

The fuel injector 10 has an injector housing 52 that is typically constructed from a plurality of individual parts. The housing 52 includes an outer casing 54 that contains block members 56, 58, and 60. The outer casing 54 has a fuel port 64 that is coupled to a fuel pressure chamber 66 by a fuel passage 68. A first check valve 70 is located within fuel passage 68 to prevent a reverse flow of fuel from the pressure chamber 66 to the fuel port 64. The pressure chamber 26 is coupled to a nozzle 72 through fuel passage 74. A second check valve 76 is located within the fuel passage 74 to prevent a reverse flow of fuel from the nozzle 72 to the pressure chamber 66.

The flow of fuel through the nozzle 72 is controlled by a needle valve 78 that is biased into a closed position by spring 80 located within a spring chamber 81. The needle valve 78 has a shoulder 82 above the location where the passage 74 enters the nozzle 78. When fuel flows into the passage 74 the pressure of the fuel applies a force on the shoulder 82. The shoulder force lifts the needle valve 78 away from the nozzle openings 72 and allows fuel to be discharged from the injector 50.

A passage 83 may be provided between the spring chamber 81 and the fuel passage 68 to drain any fuel that leaks into the chamber 81. The drain passage 83 prevents the build up of a hydrostatic pressure within the chamber 81 which could create a counteractive force on the needle valve 78 and degrade the performance of the injector 10.

The volume of the pressure chamber 66 is varied by an intensifier piston 84. The intensifier piston 84 extends through a bore 86 of block 60 and into a first intensifier chamber 88 located within an upper valve block 90. The piston 84 includes a shaft member 92 which has a shoulder 94 that is attached to a head member 96. The shoulder 94 is retained in position by clamp 98 that fits within a corresponding groove 100 in the head member 96. The head member 96 has a cavity which defines a second intensifier chamber 102.

The first intensifier chamber 88 is in fluid communication with a first intensifier passage 104 that extends through block 90. Likewise, the second intensifier chamber 102 is in fluid communication with a second intensifier passage 106.

The block 90 also has a supply working passage 108 that is in fluid communication with a supply working port 110. The supply port is typically coupled to a system that supplies a working fluid which is used to control the movement of the intensifier piston 84. The working fluid is typically a hydraulic fluid that circulates in a closed system separate from the fuel. Alternatively the fuel could also be used as the working fluid. Both the outer body 54 and block 90 have a number of outer grooves 112 which typically retain O-rings (not shown) that seal the injector 10 against the engine block. Additionally, block 62 and outer shell 54 may be sealed to block 90 by O-ring 114.

Block 60 has a passage 116 that is in fluid communication with the fuel port 64. The passage 116 allows any fuel that leaks from the pressure chamber 66 between the block 62 and piston 84 to be drained back into the fuel port 64. The passage 116 prevents fuel from leaking into the first intensifier chamber 88.

The flow of working fluid into the intensifier chambers 88 and 102 can be controlled by a four-way solenoid control valve 118. The control valve 118 has a spool 120 that moves within a valve housing 122. The valve housing 122 has openings connected to the passages 104, 106 and 108 and a drain port 124. The spool 120 has an inner chamber 126 and a pair of spool ports that can be coupled to the drain ports 124. The spool 120 also has an outer groove 132. The ends of the spool 120 have openings 134 which provide fluid communication between the inner chamber 126 and the valve chamber 134 of the housing 122. The openings 134 maintain the hydrostatic balance of the spool 120.

The valve spool 120 is moved between the first position shown in FIG. 4 and a second position shown in FIG. 5, by a first solenoid 138 and a second solenoid 140. The solenoids 138 and 140 are typically coupled to a controller which controls the operation of the injector. When the first solenoid 138 is energized, the spool 120 is pulled to the first position, wherein the first groove 132 allows the working fluid to flow from the supply working passage 108 into the first intensifier chamber 88, and the fluid flows from the second intensifier chamber 102 into the inner chamber 126 and out the drain port 124. When the second solenoid 140 is energized the spool 120 is pulled to the second position, wherein the first groove 132 provides fluid communication between the supply working passage 108 and the second intensifier chamber 102, and between the first intensifier chamber 88 and the drain port 124.

The groove 132 and passages 128 are preferably constructed so that the initial port is closed before the final port is opened. For example, when the spool 120 moves from the first position to the second position, the portion of the spool adjacent to the groove 132 initially blocks the first passage 104 before the passage 128 provides fluid communication between the first passage 104 and the drain port 124. Delaying the exposure of the ports, reduces the pressure surges in the system and provides an injector which has more predictable firing points on the fuel injection curve.

The spool 120 typically engages a pair of bearing surfaces 142 in the valve housing 122. Both the spool 120 and the housing 122 are preferably constructed from a magnetic material such as a hardened 52100 or 440c steel, so that the hystersis of the material will maintain the spool 120 in either the first or second position. The hystersis allows the solenoids to be de-energized after the spool 120 is pulled into position. In this respect the control valve operates in a digital manner, wherein the spool 120 is moved by a defined pulse that is provided to the appropriate solenoid. Operating the valve in a digital manner reduces the heat generated by the coils and increases the reliability and life of the injector.

In operation, the first solenoid 138 is energized and pulls the spool 120 to the first position, so that the working fluid flows from the supply port 110 into the first intensifier chamber 88 and from the second intensifier chamber 102 into the drain port 124. The flow of working fluid into the intensifer chamber 88 moves the piston 84 and increases the volume of chamber 66. The increase in the chamber 66 volume decreases the chamber pressure and draws fuel into the chamber 66 from the fuel port 64. Power to the first solenoid 138 is terminated when the spool 120 reaches the first position.

When the chamber 66 is filled with fuel, the second solenoid 140 is energized to pull the spool 120 into the second position. Power to the second solenoid 140 is terminated when the spool reaches the second position. The movement of the spool 120 allows working fluid to flow into the second intensifier chamber 102 from the supply port 110 and from the first intensifier chamber 88 into the drain port 124.

The head 96 of the intensifier piston 96 has an area much larger than the end of the piston 84, so that the pressure of the working fluid generates a force that pushes the intensifier piston 84 and reduces the volume of the pressure chamber 66. The stroking cycle of the intensifier piston 84 increases the pressure of the fuel within the pressure chamber 66. The pressurized fuel is discharged from the injector through the nozzle 72. The fuel is typically introduced to the injector at a pressure between 1000–2000 psi. In the preferred embodiment-, the piston has a head to end ratio of approximately 10:1, wherein the pressure of the fuel discharged by the injector is between 10,000–20,000 psi.

Figure 1:
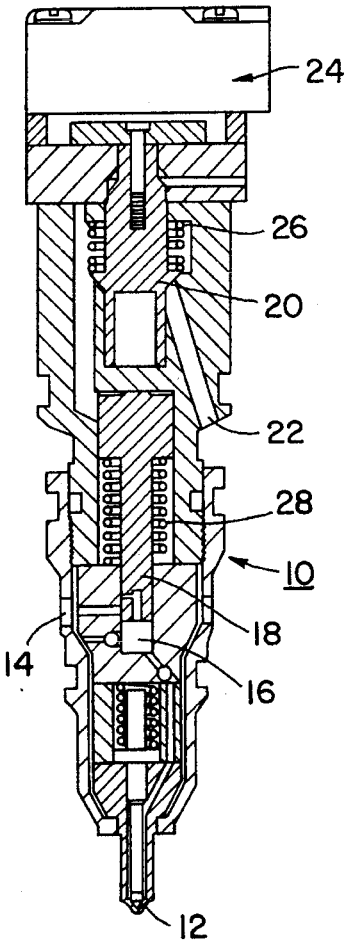
FIG. 1 PRIOR ART
FIG. 1 is a cross-sectional view of a fuel injector of the prior art.
Figure 2:
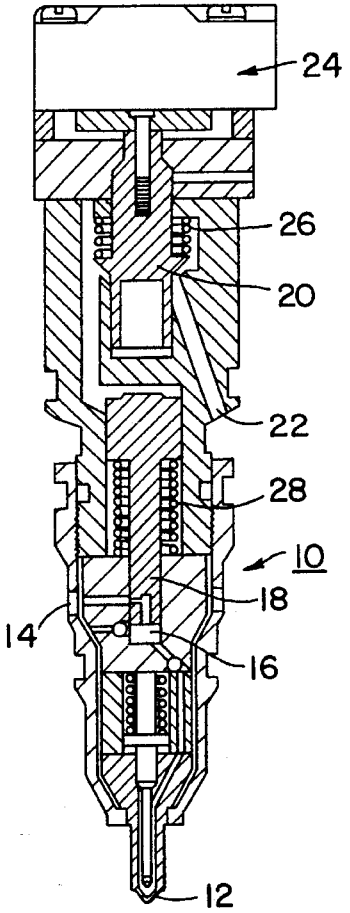
FIG. 2 PRIOR ART
FIG. 2 is a cross-sectional view similar to FIG. 1, showing the fuel injector injecting fuel.
Figure 3:
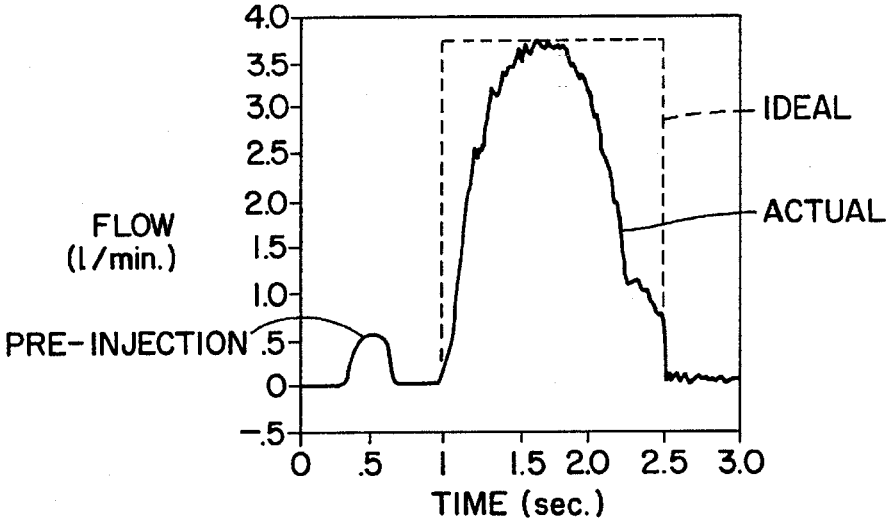
FIG. 3 is a graph showing the ideal and actual fuel injection curves for a fuel injector.

After the fuel is discharged from the injector the first solenoid 138 is again energized to pull the spool 120 to the first position and the cycle is repeated. It has been found that the double solenoid spool valve of the present invention provide a fuel injector which can more precisely discharge fuel into the combustion chamber of the engine than injectors of the prior art. The increase in accuracy provides a fuel injector that more closely approximates the square fuel curve shown in the graph of FIG. 3. The high speed solenoid control valves can also accurately supply the pre-discharge of fuel shown in the graph.

Figure 6:
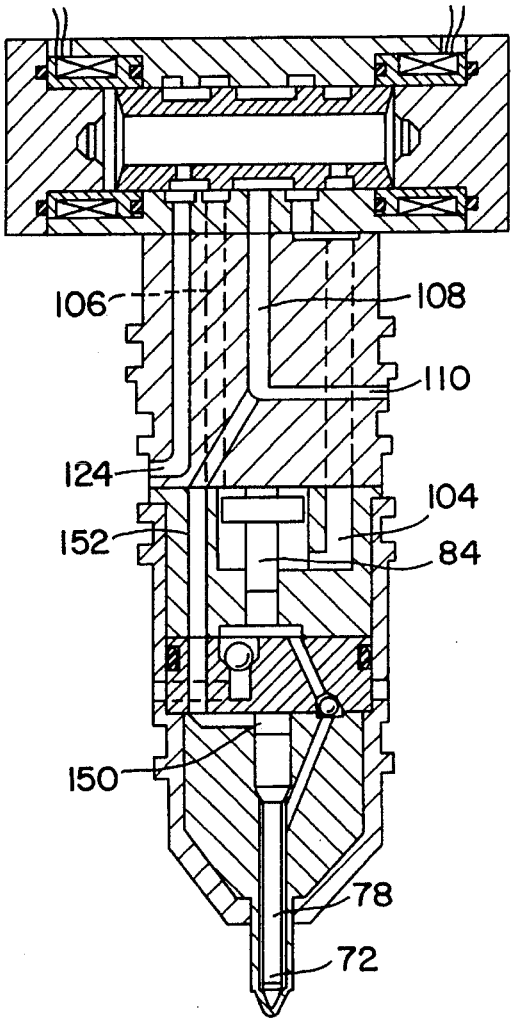
FIG. 6 is an alternate embodiment of the fuel injector of FIG. 4.

FIG. 6 shows an alternate embodiment of a fuel injector of the present invention which does not have a return spring for the needle valve. In this embodiment the supply working passage 108 is coupled to a nozzle return chamber 150 by passage 152. The needle valve 78 is biased into the closed position by the pressure of the working fluid in the return chamber 150. When the intensifier piston 84 is stroked, the pressure of the fuel is much greater than the pressure of the working fluid, so that the fuel pressure pushes the needle valve 78 away from the nozzle openings 72. When the intensifier piston 84 returns to the original position, the pressure of the working fluid within the return chamber 150 moves the needle valve 78 and closes the nozzle 72.

Figure 7:
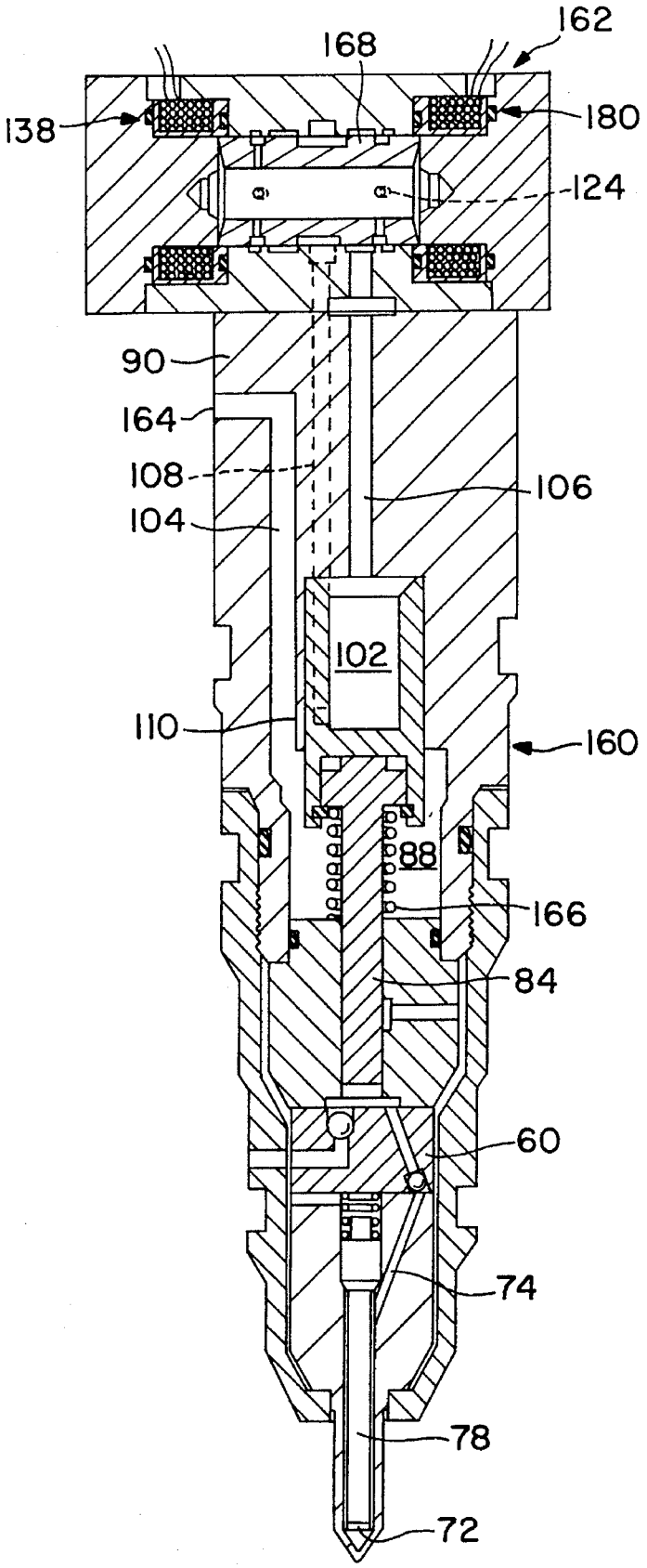
FIG. 7 is a cross-sectional view of an alternate embodiment of a fuel injector which has a three-way control valve.

FIG. 7 shows an injector 160 controlled by a three-way control valve 162. In this embodiment, the first passage 108 is connected to a drain port 164 in block 90, and the intensifier piston 84 has a return spring 166 which biases the piston 84 away from the needle valve 78. Movement of the spool 168 provides fluid communication between the second passage 106 and either the supply port 110 or the drain port 124.

When the spool 168 is in the second position, the second passage 106 is in fluid communication with the supply passage 108, wherein the pressure within the second intensifier chamber 102 pushes the intensifier piston 84 and pressurized fuel is ejected from the injector 160. The fluid within the first intensifier chamber 88 flows through the drain port 164 and the spring 166 is deflected to a compressed state. When the spool 168 is pulled by the first solenoid 138 back to the first position, the second passage 106 is in fluid communication with the drain port 124 and the second intensifier chamber 102 no longer receives pressurized working fluid from the supply port 110. The force of the spring 166 moves the intensifier piston 84 back to the original position. The fluid within the second intensifier chamber 102 flows through the drain port 124.

Both the three-way and four-way control valves have inner chambers 126 that are in fluid communication with the valve chamber 132 through spool openings 134, and the drain ports 124 through ports 130. The ports inner chamber and openings insure that any fluid pressure within the valve chamber is applied equally to both ends of the spool. The equal fluid pressure balances the spool so that the solenoids do not have to overcome the fluid pressure within the valve chamber when moving between positions. Hydrostatic pressure will counteract the pull of the solenoids, thereby requiring more current for the solenoids to switch the valve. The solenoids of the present control valve thus have lower power requirements and generate less heat than injectors of the prior art, which must supply additional power to overcome any hydrostatic pressure within the valve. The balanced spool also provides a control valve that has a faster response time, thereby increasing the duration interval of the maximum amount of fuel emitted by the injector. Increasing the maximum fuel duration time provides a fuel injection curve that is more square and more approximates an ideal curve.

As shown in FIG. 4, the ends of the spool 120 may have concave surfaces 170 that extend from an outer rim to openings 134 in the spool 120. The concave surfaces 170 function as a reservoir that collects any working fluid that leaks into the gaps between the valve housing 122 and the end of the spool. The concave surfaces significantly reduce any hydrostatic pressure that may build up at the ends of the spool 120. The annular rim at the ends of the spool 120 should have an area sufficient to provide enough hysteris between the spool and housing to maintain the spool in position after the solenoid has been de-energized.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An upper fuel injector unit coupled to a lower fuel injector unit that has a nozzle coupled to a fuel port that receives a fuel, comprising:

a housing that has a supply working port and a return working port for receiving and releasing a working fluid;

an intensifier that moves between a return position and a power position, wherein said intensifier increases a fuel pressure to the nozzle when in the power position, said intensifier being adjacent to a first intensifier chamber and a second intensifier chamber;

a valve housing;

a spool that is located within said valve housing and moves between a first position and a second position wherein an end of said spool is in contact with said valve housing when said spool is in said first or second position, said spool being operatively connected to said working fluid ports and said intensifier chambers so that said first intensifier chamber is in fluid communication with said supply working port and said second intensifier chamber is in fluid communication with said return working port when said spool is in said first position, wherein said first intensifier chamber is pressurized and said intensifier moves to the return position, and said first intensifier chamber is in fluid communication with said return working port and said second intensifier chamber is in fluid communication with said supply working port when said spool is in said second position, wherein said second intensifier chamber is pressurized and said intensifier moves to the power position;

a first solenoid that can be energized to move said spool from said second position to said first position; and, a second solenoid that can be energized to move said spool from said first position to said second position, wherein said valve housing and said spool are constructed from a material with enough residual magnetism to maintain said spool position when said solenoids are de-energized and allows said spool end to be separated from said valve housing when said solenoid is energized.

2. The upper fuel unit injector as recited in claim 1, wherein the working fluid is also the fuel.

3. The upper fuel unit injector as recited in claim 1, wherein said housing has a supply working passage between said supply working port and said spool, a return working passage between said return working port and said spool, a first intensifier passage between said first intensifier chamber and said spool valve and a second intensifier passage between said second intensifier chamber and said spool, said spool having a first groove that provides fluid communication between said supply working passage and said first intensifier passage when said spool is in said first position and fluid communication between said supply working passage and said second intensifier passage when said spool is in said second position, said spool also having a pair of passages and an internal chamber that provide fluid communication between said second intensifier passage and said return working passage when said spool is in said first position, and fluid communication between said first intensifier passage and said return working passage when said spool is in said second position.

4. The upper fuel injector unit as recited in claim 3, wherein said spool moves within a valve chamber of spaced valve housing, said spool having a pair of openings that provide fluid communication between said inner chamber and said valve chamber.

5. The upper fuel injector unit as recited in claim 1, wherein said valve housing has a pair of bearing surfaces, said spool being cylindrical in shape with a pair opposite ends that engage said bearing surface and an outer longitudinal wall between said ends which contain the groove and the passages.

6. The upper fuel injector unit as recited in claim 5, wherein said valve housing and said spool are constructed from a steel.

7. A fuel injector, comprising:

a housing that has a fuel port for receiving a fuel, a supply working port and a return working port for receiving and releasing a working fluid, said housing further having a supply working passage in fluid communication with said supply working port, a return working passage in fluid communication with said return working port, a first intensifier passage in fluid communication with a first intensifier chamber and a second intensifier passage in fluid communication with a second intensifier chamber;

a nozzle that discharges the fuel from said housing;

an intensifier that moves between a return position and a power position, wherein said intensifier increases a fuel pressure to the nozzle when in the power position, said intensifier being adjacent to said first intensifier chamber and said second intensifier chamber;

a valve housing;

a spool that is located within said valve housing and moves between a first position and a second position wherein an end of said spool is in contact with said valve housing when said spool is in said first or second position, said spool having a first groove that provides fluid communication between said supply working passage and said first intensifier passage when said spool valve is in said first position and fluid communication between said supply working passage and said second intensifier passage when said spool is in said second position, said spool also having a pair of passages and an internal chamber that provide fluid communication between said second intensifier passage and said return working passage when said spool is in said first position, and fluid communication between said first intensifier passage and said return working passage when said spool is in said second position, wherein said first intensifier chamber is pressurized and said intensifier moves to the return position when said spool is in the first position and said second intensifier chamber is pressurized and said intensifier moves to the power position when said spool is in the second position;

a first solenoid operatively connected to said spool to move said spool from said second position to said first position; and, a second solenoid operatively connected to said spool to move said spool from said first position to said second position wherein said valve housing and said spool are constructed from a material with enough residual magnetism to maintain said spool position when said solenoids are de-energized and allows said spool end to be separated from said valve housing when said solenoid is energized.

8. The fuel injector as recited in claim 7, wherein said spool moves within a valve chamber of said valve housing, said spool having a pair of openings that provide fluid communication between said inner chamber and said valve chamber.

9. The fuel injector as recited in claim 7, wherein said housing has a passage that provides fluid communication between said fuel port and a spring chamber which houses a spring that biases said nozzle.

10. The fuel injector as recited in claim 7, wherein said housing has a passage that provides fluid communication between said supply working passage and a nozzle return chamber.

11. The fuel injector as recited in claim 7, wherein the working fluid is also the fuel.

12. The fuel injector as recited in claim 7, wherein said valve housing has a pair of bearing surfaces, said spool being cylindrical in shape with a pair opposite ends that engage said bearing surface and an outer longitudinal wall between said ends which contain the groove and the passages.

13. The fuel injector as recited in claim 12, wherein said valve housing and said spool are constructed from a magnetic steel.

14. An upper fuel injector unit coupled to a lower fuel injector unit that has a nozzle coupled to a fuel port that receives a fuel, comprising:

a housing that has a supply working port and a return working port for receiving and releasing a working fluid;

an intensifier that moves between a return position and a power position, wherein said intensifier increases a fuel pressure to the nozzle when in the power position, said intensifier being adjacent to a spring chamber and an intensifier chamber, said spring chamber being in fluid communication with said return working port;

a spring within said spring chamber, said spring biases said intensifier to the return position;

a valve housing;

a spool that moves between a first position and a second position wherein an end of said spool is in contact with said valve housing when said spool is in said first or second position, said spool being operatively connected to said working fluid ports and said intensifier chambers so that said intensifier chamber is in fluid communication with said return working port when said spool is in said first position, wherein said spring moves said intensifier to the return position, and said intensifier chamber is in fluid communication with said supply working port when said spool is in said second position, wherein said second intensifier chamber is pressurized and said intensifier moves to the power position;

a first solenoid that can be energized to move said spool from said second position to said first position; and, a second solenoid that can be energized to move said spool from said first position to said second position, wherein said valve housing and said spool are constructed from a material with enough residual magnetism to maintain said spool position when said solenoids are de-energized and allows said spool end to be separated from said valve housing when said solenoid is energized.

15. The upper fuel injector unit as recited in claim 14, wherein the working fluid is also the fuel.

16. The upper fuel injector unit as recited in claim 14, wherein said housing has a supply working passage connected to said supply working port and said spool, a return working passage connected to said return working port and said spool, a first intensifier passage connected to said spring chamber and said return working port and a second intensifier passage connected to said second intensifier chamber and said spool, said spool having a groove that provides fluid communication between said supply working passage and said intensifier passage when said spool is in said first position and fluid communication between said intensifier passage and said return working passage when said spool is in said second position.

17. The upper fuel injector unit as recited in claim 16, wherein said spool moves within a valve chamber of said valve housing, said spool having a pair of openings that provide fluid communication between said inner chamber and said valve chamber.

18. The upper fuel injector unit as recited in claim 16, wherein said valve housing has a pair of bearing surfaces, said spool being cylindrical in shape with a pair opposite ends that engage said bearing surface and an outer longitudinal wall between said ends which contain the groove and the passages.

19. The upper fuel injector unit as recited in claim 18, wherein said valve housing and said spool are constructed from a magnetic steel.

20. A fuel injector, comprising:

a housing that has a fuel port for receiving a fuel, a supply working port and a return working port for receiving and releasing a working fluid, said housing further having a supply working passage in fluid communication with said supply working port, a return working passage in fluid communication with said return working port, a first intensifier passage in fluid communication with said first intensifier chamber and a second intensifier passage in fluid communication with said second intensifier chamber;

a nozzle that discharges the fuel from said housing;

an intensifier that moves between a return position and a power position, wherein said intensifier increases a fuel pressure to the nozzle when in the power position, said intensifier being adjacent to a spring chamber and an intensifier chamber, said spring chamber being in fluid communication with said return working port;

a spring within said spring chamber, said spring biases said intensifier to the return position;

a valve housing;

a spool that is located within said valve housing and moves between a first position and a second position wherein an end of said spool is in contact with said housing when said spool is in said first or second position, said spool having a groove that provides fluid communication between said return working passage and said intensifier passage when said spool is in said first position, wherein said spring moves said intensifier to the return position, and said intensifier chamber is in fluid communication with said supply working port when said spool is in said second position, wherein said intensifier chamber is pressurized and said intensifier moves to the power position;

a first solenoid operatively connected to to move;

a first solenoid that can be energized to move said spool from said second position to said first position; and, a second solenoid that can be energized to move said spool from said first position to said second position, wherein said valve housing and said spool are constructed from a material with enough residual magnetism to maintain said spool position when said solenoids are de-energized and allows said spool end to be separated from said valve housing when said solenoid is energized.

21. The fuel injector as recited in claim 20, wherein said spool moves within a valve chamber of said valve housing, said spool having a pair of openings that provide fluid communication between said inner chamber and said valve chamber.

22. The fuel injector as recited in claim 20, wherein said housing has a passage that provides fluid communication between said fuel port and a spring chamber which houses a spring that biases said nozzle.

23. The fuel injector as recited in claim 20, wherein said housing has a passage that provides fluid communication between said supply working passage and a nozzle return chamber.

24. The fuel injector as recited in claim 20, wherein the working fluid is also the fuel.

25. The fuel injector as recited in claim 20, wherein said valve housing has a pair of bearing surfaces, said spool being cylindrical in shape with a pair opposite ends that engage said bearing surface and an outer longitudinal wall between said ends which contain the groove and the passages.

26. The fuel injector as recited in claim 25, wherein said valve housing and said spool are constructed from a magnetic steel.

* * * * *

UNITED STATES PATENT AND TRADEMARK OFFICE

CERTIFICATE OF CORRECTION

PATENT NO. : 5,460,329

DATED : October 24, 1995

INVENTOR(S) : Sturman

It is certified that error appears in the above-identified patent and that said Letters Patent is hereby corrected as shown below:

In column 5 at line 5, please delete " - ".

In column 7, claim 4 at line 26, please delete " spaced " and insert -- said --.

In column 9, claim 18 at line 40, please delete " 16 " and insert -- 14 --.

In column 10, claim 20 at line 24, please delete " a first solenoid operatively connected to to move; ".

Signed and Sealed this

Twentieth Day of May, 1997

*Attest:*

Bruce Lehman

BRUCE LEHMAN

*Attesting Officer*

*Commissioner of Patents and Trademarks*